US005727354A

United States Patent [19]

Clément

[11] Patent Number: 5,727,354

[45] Date of Patent: Mar. 17, 1998

[54] FASTENING SYSTEM FOR JUXTAPOSED AND PARALLEL LATHS

[75] Inventor: Michel Clément, Trois-Rivières Ouest, Canada

[73] Assignee: Triangle Pacific Corp., Dallas, Tex.

[21] Appl. No.: 347,396

[22] PCT Filed: May 21, 1992

[86] PCT No.: PCT/CA92/00215

§ 371 Date: Feb. 21, 1995

§ 102(e) Date: Feb. 21, 1995

[87] PCT Pub. No.: WO93/23636

PCT Pub. Date: Nov. 25, 1993

[51] Int. Cl.[6] ..... E04F 13/08; E04F 15/22

[52] U.S. Cl. ..... 52/387; 52/403.1; 52/480; 52/512

[58] Field of Search ..... 52/384, 385, 391, 52/480, 512, 719, 403.1, 387, 509

[56] References Cited

U.S. PATENT DOCUMENTS

| | | | |
|---|---|---|---|
| 1,968,798 | 7/1934 | Cherry . | |
| 2,004,917 | 6/1935 | Johnson . | |
| 2,882,560 | 4/1959 | Plandl | 52/391 X |
| 3,005,293 | 10/1961 | Hunter | 52/385 |
| 3,045,294 | 7/1962 | Livezey, Jr. . | |
| 3,619,963 | 11/1971 | Omholt | 52/480 X |
| 3,713,264 | 1/1973 | Morgan, Jr. | 52/480 X |
| 4,170,859 | 10/1979 | Counihan . | |
| 4,272,938 | 6/1981 | Seipos . | |
| 4,407,104 | 10/1983 | Francis . | |
| 4,481,749 | 11/1984 | Stirling . | |
| 4,694,627 | 9/1987 | Omolt | 52/403.1 X |
| 4,856,245 | 8/1989 | Osawa . | |
| 5,016,413 | 5/1991 | Counihan . | |

FOREIGN PATENT DOCUMENTS

| | | |
|---|---|---|
| 528 118 | 6/1980 | Australia . |
| 2019 363 | 7/1970 | France . |
| 2621160 | 11/1977 | Germany . |
| 4110749 | 10/1991 | Germany . |

*Primary Examiner*—Michael Safavi
*Attorney, Agent, or Firm*—Adams Law Firm, P.A.

[57] ABSTRACT

A fastening system for laths made of wood or similar material, serving to form a floor. The system makes it possible to fasten the laths so that they are juxtaposed without damaging them by using tongues in which bearings, provided with teeth, have been stamped. These tongues are placed on the subfloor and are either fastened directly, or secured in place by gravity using flexible rubber supports and alignment laths securing them at an equal distance from one another, thereby not damaging the subflooring. This fastening system makes it possible to easily install and remove laths and is very well adapted for its use with prevarnished wooden laths.

15 Claims, 6 Drawing Sheets

FASTENING SYSTEM FOR JUXTAPOSED AND PARALLEL LATHS

Figure 1:
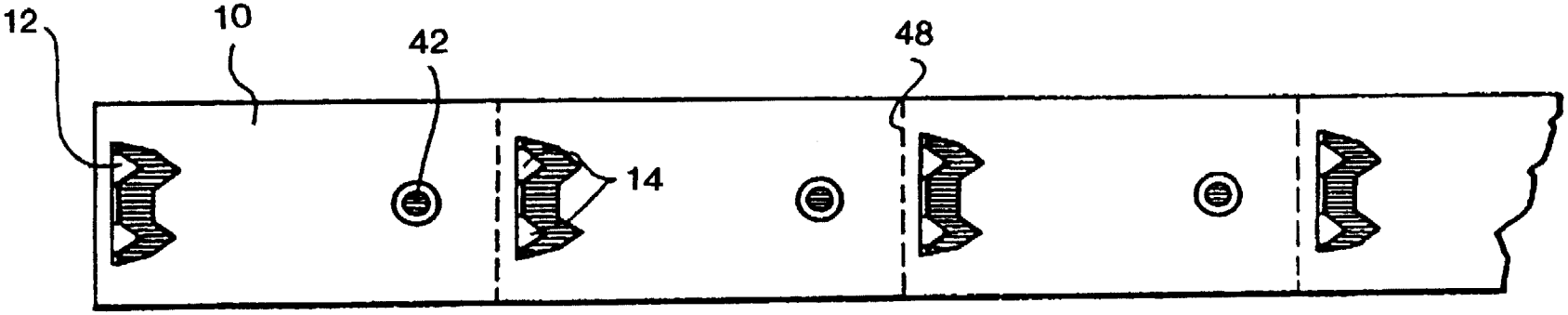

The present invention concerns a fastening system for the assembly of juxtaposed and parallel laths, made of wood and whose upper surface is prevarnished, in order to line a surface, such as a floor or wall. Each lath has a tenon and a mortise, each of which is placed on one of its longitudinal sides. During the installation, the laths are arranged so that their tenon fits together with the mortise of an adjacent lath.

The most widely used conventional method for installing a wood lining consists of attaching the boards directly to the subfloor using nails or clasps which are inserted in the subfloor with pneumatic hammers. These nails or clasps firmly secure the laths to the subfloor, but as a result of their passage through the wood, which is relatively dry, they produce slight imperfections which are perceptible on the surface of the laths. Moreover, the nails and clasps occasionally cause the wood to split up to the surface. The laths thereby damaged become unusable.

The conventional installation method does not assure a perfect alignment of the laths with the subfloor. Several factors may actually vary the lath alignment with one another if, for example, a board which is narrower than the others is installed in the middle of a row or one of the laths is cambered. The laths may also show among themselves a slight angular deviation, which produces rounded rows, more particularly noticeable if the surface is large.

The conventional fastener method generates flaws which often make the floor unattractive. Moreover, it is very difficult to remove laths without damaging them and quite often, the laths must be broken up to be removed. It is therefore not possible for someone to have a lath board installed and removed when this person moves away or if the floor is installed only temporarily, for an exhibit, for example.

Floor laths installed in a traditional manner may push against one another under the effect of humidity and thereby create large gaps in certain areas due to shrinkage in drying.

When the floor is worn and must be sanded and varnished, it is not possible to remove it to perform these operations elsewhere; the sanding and varnishing must be performed on site with all the drawbacks that this entails, both for the occupants and for the workers. The sanding and varnishing operations of a wood floor in a home or commercial building often require the occupants to leave the premises during the repair operations which may last several days. During this period, the sanding generates a fine dust which spreads everywhere and which will require the entire home or building to be cleaned. Moreover, the machines used for sanding may damage the floor permanently if they are not properly used, and therefore require qualified labor. As for varnishes and other finishing products, most release harmful, sometimes explosive solvent fumes, and very strong odors which are harmful to the health of the workers and which contaminate the air of the home or building. The drying and hardening times of the varnish prolong accordingly the period of unavailability of the rooms involved.

In order to resolve the drawbacks of the sanding and varnishing of the laths on the site itself where they are used, prevarnished laths are commercially available and these may be returned to the factory when they are worn in order to be sanded and revarnished. The factory, with the appropriate equipment, allows all of these operations to be performed without affecting the health of the workers. Moreover, the solvent fumes may be filtered.

Among the solutions proposed for removing the laths without damaging them, we find, for example, the systems described in the following patents: U.S. Pat. Nos. 1,968,798, 2,004,917, CA-A-898 480, CA-A-903 436, CA-A-965 569 and CA-A-1 165 088. These systems propose attachments, of various forms, sliding in parallel rails in order to secure the cross laths without damaging them. The user must remove the mobile attachments in order to remove the wood laths. These systems offer nothing regarding the synchronization of the lath positioning or installation of a floor above an existing lining without damaging the latter.

Certain patents, such as the following patents: U.S. Pat. Nos. 3,187,389, 4,272,938, CA-A-405 366 and CA-A-571 352, propose individual clasps securing the laths in place without damaging them. These clasps do not make it possible to solve the synchronization problem or the installation of a floor above an existing lining without damaging the latter. Moreover, the clasps may break up when they are removed.

U.S. Pat. No. 1,988,201 presents a system in which the plates, folded to fit together, are placed under the laths while securing them. However, this system requires a large quantity of metal and does not solve the problem of installing a floor above an existing lining without damaging the latter. Moreover, the laths must be specifically machined for their use with this system.

Patent CA-A-579 973 presents a system in which metal tongues have attachments formed by stamping, which interlock the junctions between the tenons and mortises of the laths. The attachments must, however, be folded to fit the form of the tenon and mortise, and therefore undergo a permanent deformation. These attachments can break when the laths are removed and the tongues must therefore be replaced. Additionally, this system does not solve the problem of installing a floor above an existing lining without damaging the latter.

The present invention proposes a fastening system for juxtaposed and parallel laths permitting a synchronized installation and the installation of laths, particularly prevarnished wood laths, without damaging them while providing them with a perfect alignment. It also proposes a system for installing a floor above an existing lining without damaging the latter.

The system of the present invention has the advantage of being usable with standard boards that can even be fastened in the traditional manner and are reusable and do not need to be removed at the same time the laths are removed.

Another advantage of the invention is to facilitate the installation of the floor so that a person with little experience in the field and minimum equipment can install it himself.

The present invention therefore proposes a fastening system for assembling juxtaposed and parallel laths, in order to line a surface, each of the laths having a given width and being provided with an upper surface, a lower surface and [Translator's Note: the following phrase was crossed out by pen: two lateral sides, one of which has a tenon and the other a mortise, the tenon can be inserted in the mortise of an adjacent lath]. The fastening system includes:

- a set of thin and rigid tongues, which are to be placed parallel to one another on the surface to be lined in order to receive the lower lath surfaces, the tongues reaching out crosswise to the laths;
- means for securing the tongues in place with respect to one another;
- a set of supports projecting upward, arranged over the tongues, the bearings being spaced apart by the same distance as the width of the laths to be fastened;

the fastening system is characterized in that:

- the bearings are provided with an upper end, the end of which exhibits at least one tooth essentially parallel to the tongues, the bearings and teeth being obtained by stamping the tongues;

at least one tooth projecting in the same longitudinal direction as the tongues, the bearings and at least one tooth being dimensioned so that at least one tooth can fit in a mortise and one tenon can in turn be inserted into it to prevent the laths from lifting and allow them to be positioned in relation to one another at a predetermined distance;

the bearings of each of the tongues are aligned with the bearings of the adjacent tongues.

According to a preferred first embodiment of the invention, the means for securing the tongues in place with respect to one another include holes, made through the tongues, in which screws are placed. These screws are provided with a flat head and penetrate into the surface to be lined so as to rigidly attach the tongues to the latter.

According to a second preferred embodiment of the invention, the system includes the following supplementary elements:

the tongues have lateral walls projecting downward and reaching out in a longitudinal direction from the tongues so that each tongue holds its corresponding flexible support as a vise;

the means for holding the tongues in place with respect to one another include a set of alignment laths placed perpendicular to the tongues with respect to the lateral openings made in the lateral walls of the tongues;

the alignment laths have lateral edges provided with pairs of symmetrical recesses fitting together with the lateral walls around the openings and cross the tongues while passing between them and their flexible support, the tongues and alignment laths being arranged so that each of the tongues fits together with recesses when the alignment laths cross it.

Figure 2:
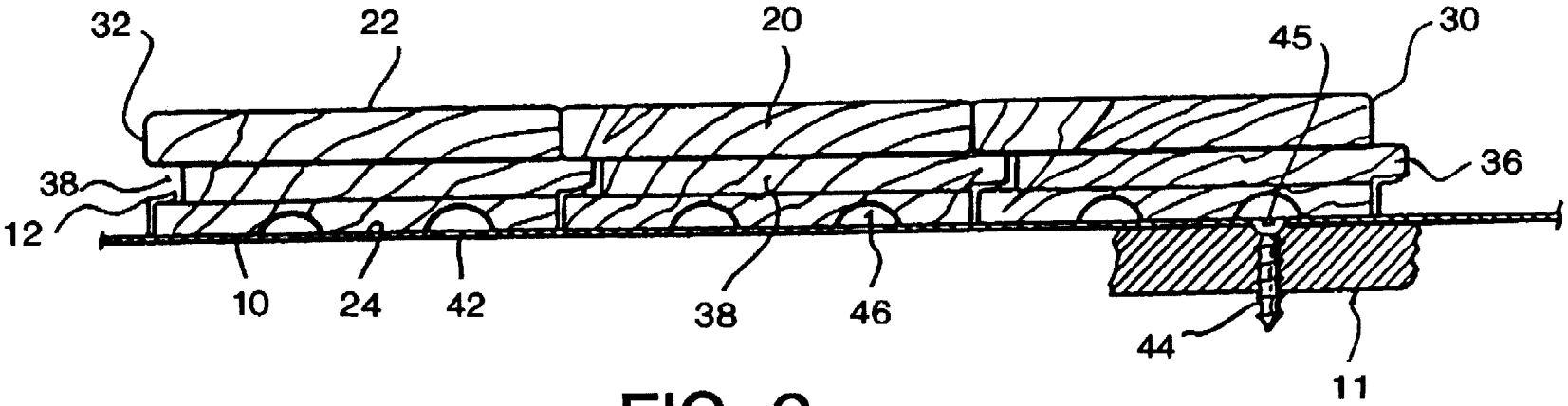
Figure 3:
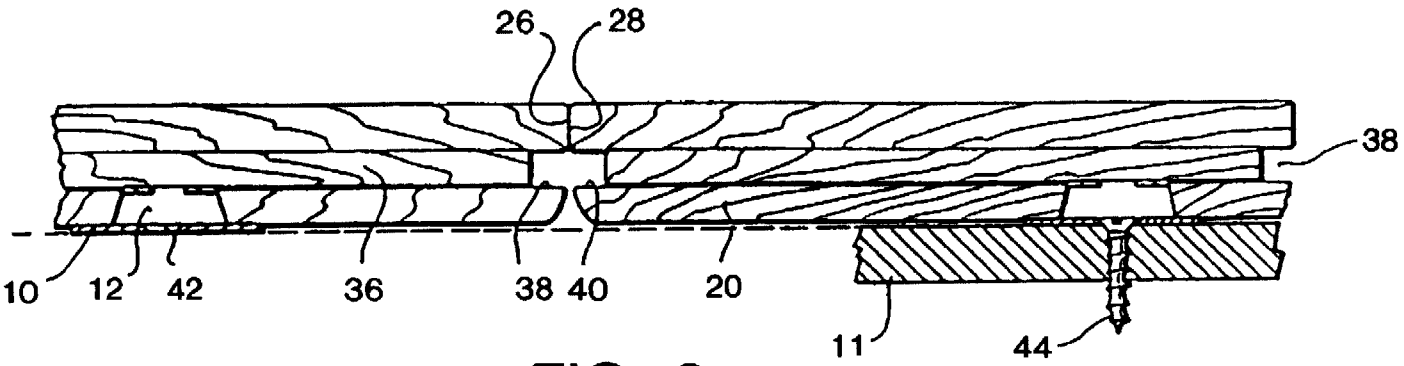
Figure 4:
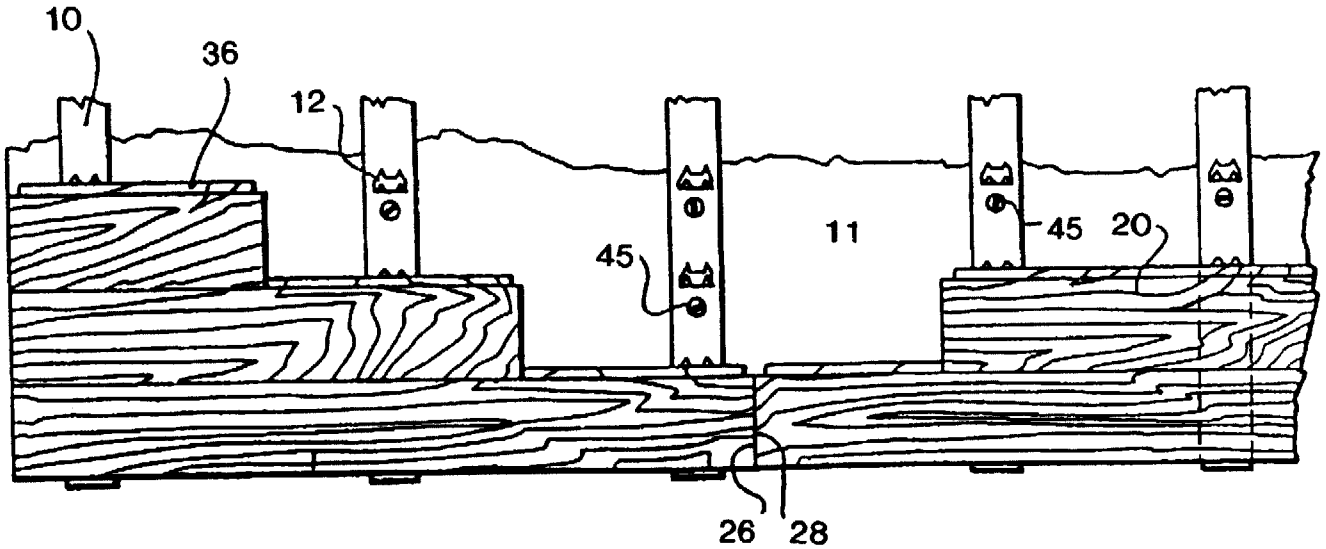
Figure 5:
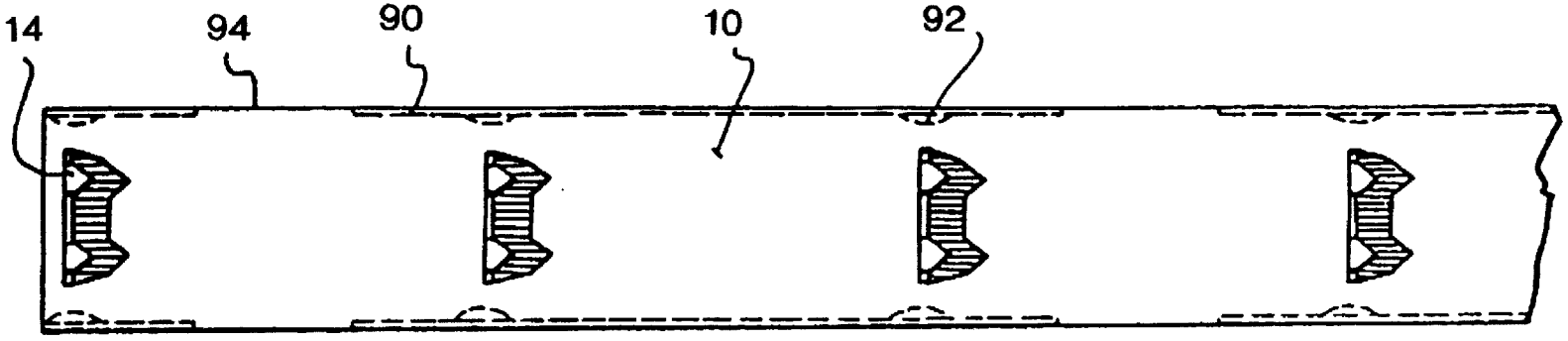
Figure 6:
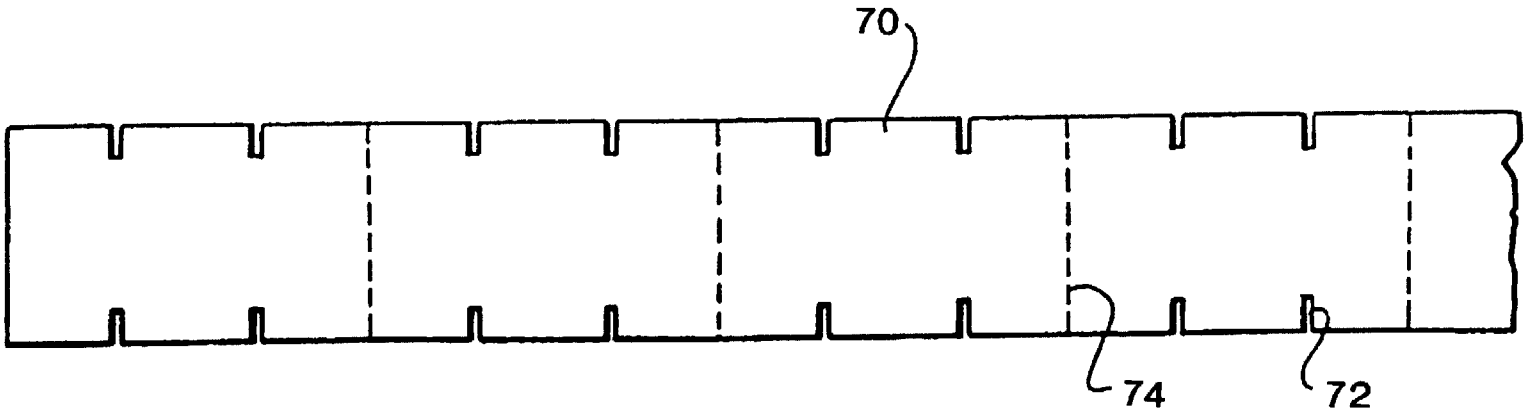
Figure 7:
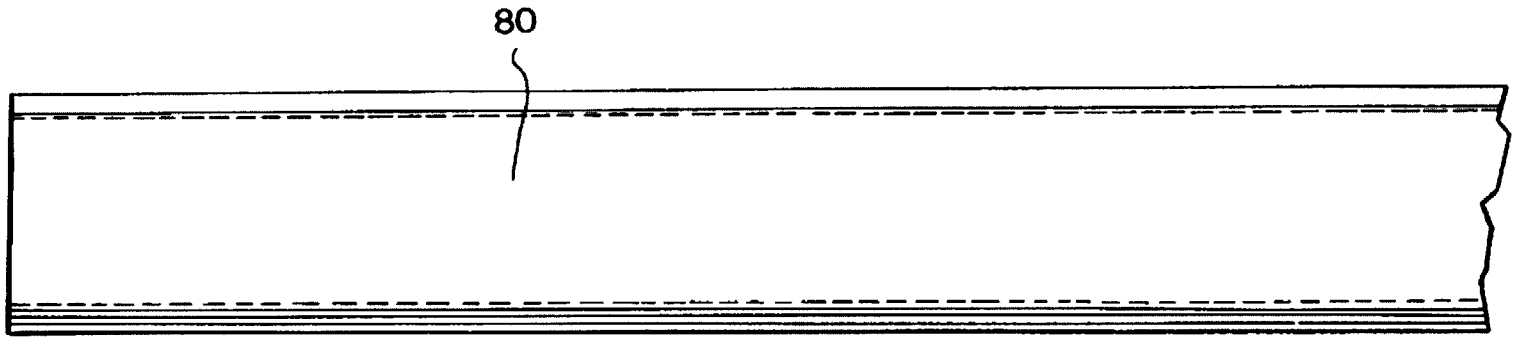
Figure 8:
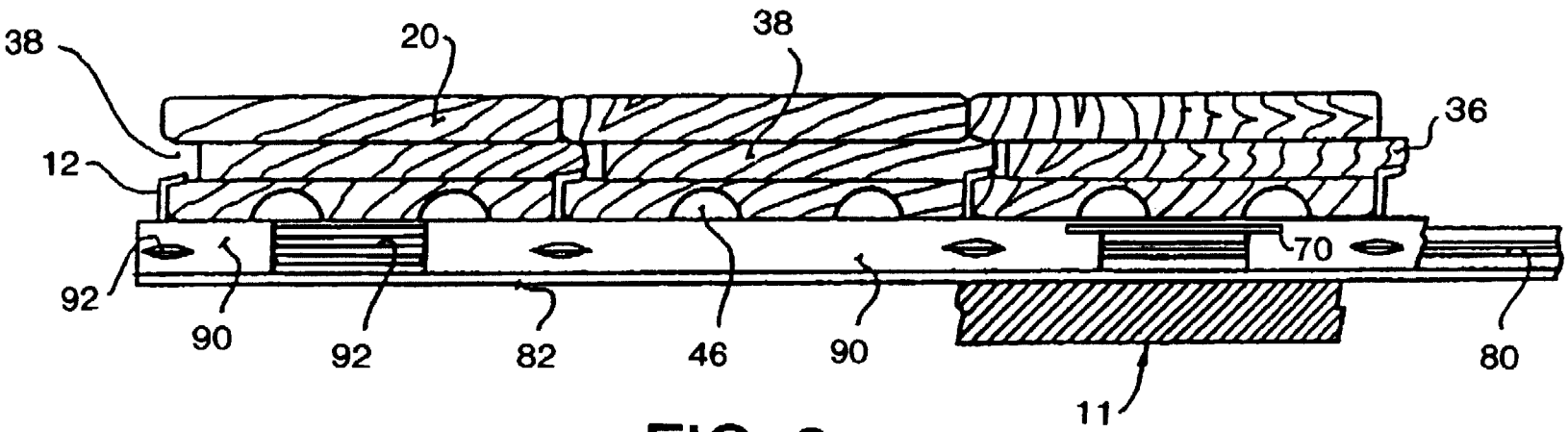
Figure 9:
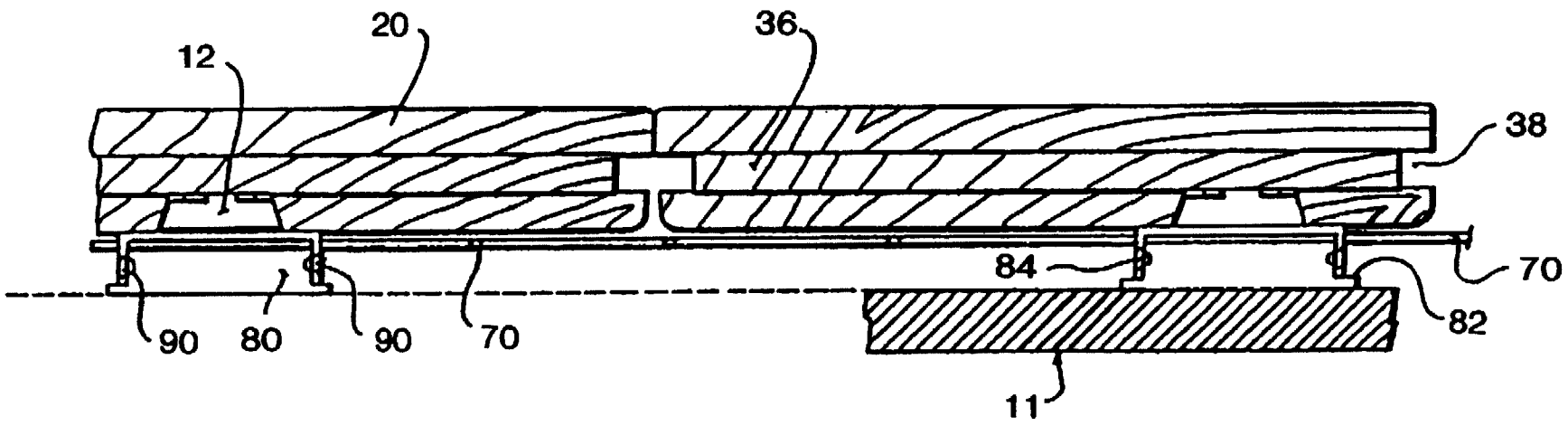
Figure 10:
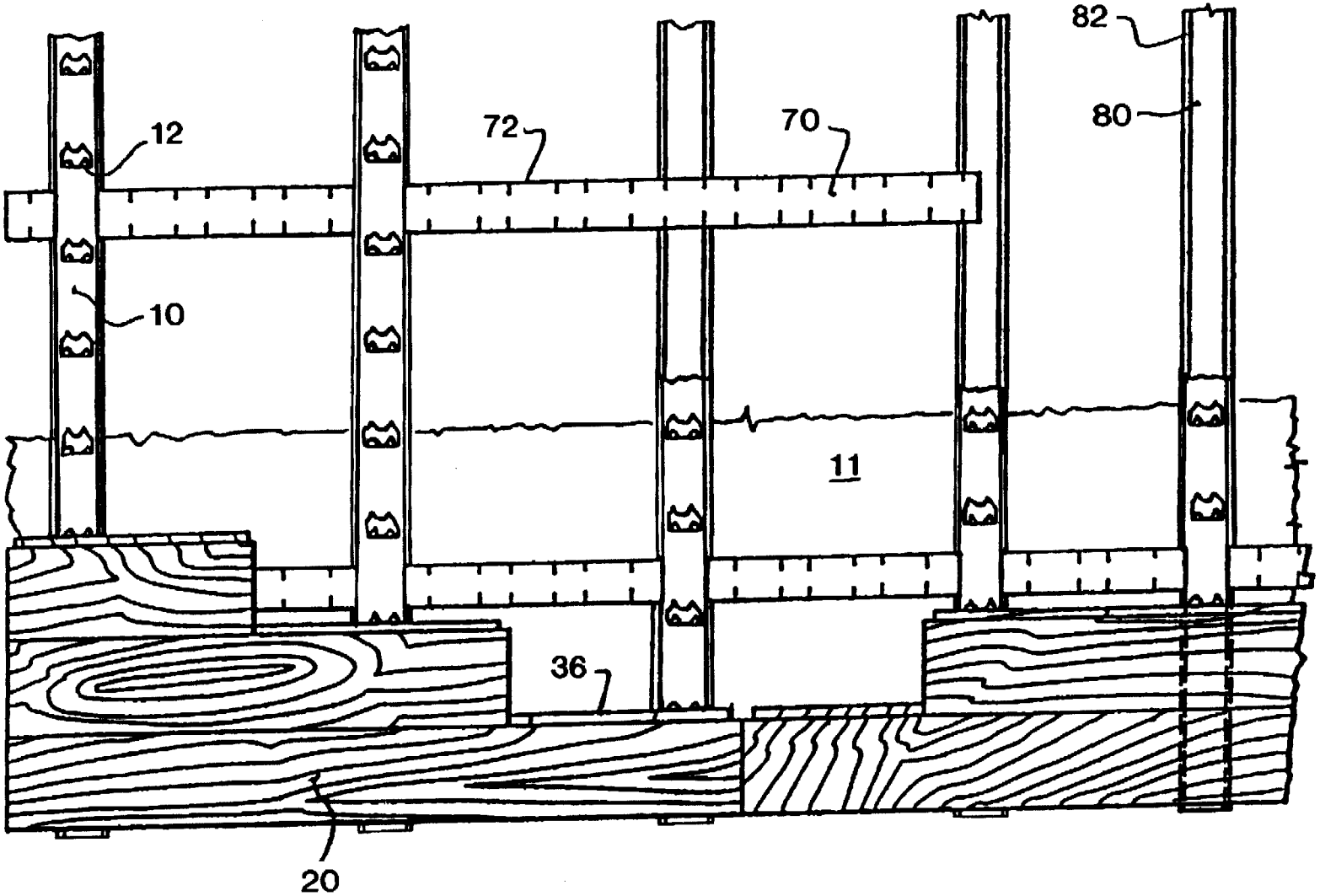

The invention will be more clearly understood by reading the following nonlimiting description of a preferred embodiment of the invention provided in reference to the attached drawings in which:

FIG. 1 represents a top view of a tongue according to the first preferred embodiment of the invention, FIG. 2 represents a side view of a tongue securing the laths according to the first preferred embodiment of the invention, FIG. 3 represents an elevated view of FIG. 2, FIG. 4 represents a top view of the tongues securing the laths according to the first embodiment, FIG. 5 represents a top view of one tongue according to a second preferred embodiment of the invention, FIG. 6 represents a top view of an alignment lath, FIG. 7 represents a top view of a flexible support, FIG. 8 represents a side view of a tongue securing the laths according to a second preferred embodiment of the invention, FIG. 9 represents an elevated view of FIG. 8, FIG. 10 represents a top view of the tongues securing the laths according to the second preferred embodiment of the invention.

The fastening system according to the invention, illustrated in FIGS. 1 to 10, includes tongues (10) made of tempered steel and in which bearings (12), which are projected upward, are stamped. The bearings (12) are provided, at their end, with two teeth (14) in the form of a tip, folded at 90° parallel to the surface of the tongues (10) and projecting upward slightly. The bearings (12) and the teeth (14) are formed by stamping. Their purpose is to prevent the laths (20) from raising by securing them to the ground.

The laths (20) include an upper surface (22), a lower surface (24), two ends (26) and (28) and two lateral sides (30) and (32). The lateral side (30) comprises a tenon (36), essentially reaching out over the entire longitudinal length of the lath (20), and the lateral side (32) comprises a mortise (38) reaching out over the entire longitudinal length of the lath (20). The ends (26) and (28) comprise, respectively, a mortise (38) and (40). Longitudinal grooves (46), made on the lower surface (24) make it possible to prevent the laths (20) from rounding under excess humidity.

The laths (20) have an upper surface (22), preferably prevarnished in the factory so that no varnishing is required after the installation. When the floor is worn, or if it is necessary to change the color, the laths (20) can be removed and returned to the factory to perform the necessary operations. However, sanding and varnishing may be performed on site, if necessary.

The bearings (12) have a height equal to the distance between the lower surface (24) of the laths (20) and the lower portion of the mortises (38). The distance between the bearings (12) is equal to the width of the laths (20). As illustrated in FIGS. 2 and 8, the teeth (14), which point upward slightly, are placed tightly on the surface of the bottom of the mortises (38) and still leave enough room for the tenons (36).

During the assembly, the tongues (10) are placed parallel to one another on the surface to be lined (11). The bearings (12) of the tongues (10) must be aligned with one another so that the laths (20), placed crosswise on the tongues (10), can be installed. Each row of laths (20) is mounted one after the other in the direction in which the teeth point (14).

First, each lath (20) of the first row is installed so that the bottom of their mortise (38) is inserted against the bearing (12) and under the teeth (14), as illustrated in FIGS. 2 and 8. The laths (20) of a same row are placed end-to-end and it is not necessary that they all have the same length. The laths (20) are then lowered against the ground, so that their tenon (36) comes to rest freely on the next set of bearings (12). Since each tooth (14) points upward slightly, their tip inserts into the tenon (36) slightly, thereby preventing them from damaging the next laths at the time of the insertion.

The next row of laths (20) is installed against the set of bearings (12) against which the tenons (36) of the first row rest. The bottom part of their mortise (38) is inserted against these bearings (12) and under their teeth (14), thereby locking the tenons (36) of the first row of laths (20). The preceding row of laths (20) is therefore tightly secured. The other rows are installed in the same manner until the floor has the desired width. Note that the ends (26) and (28) of the laths (20) are not aligned with those of the adjacent rows. This makes the floor more attractive and stronger.

The major difference between the two preferred embodiment modes of the invention is the means used for securing the tongues (10) in place in relation to one another.

According to a first embodiment of the invention, illustrated in FIGS. 1 to 4, the surface to be lined (11) is a subfloor in which screws may be inserted. Tongues (10) have holes (42) in which screws (44) are placed which serve to fasten firmly the tongues (10) to the subfloor (11). These screws (44) each have a very flat head (45) which fits into small depressions around holes (42).

Since the tongues (10) are not always exactly the proper length, it is often necessary to cut them in order to shorten them or to make short ends to lengthen a too short tongue (10). The cut of the tongues (10), according to a first embodiment, comprises marks (48) serving as a cutting mark and thereby making it possible to maintain the synchronization of the installation.

The fastening system as described in the first embodiment mode may be applied both for covering a floor and wall and even a ceiling.

According to the second preferred embodiment mode of the invention, illustrated in FIGS. 5 to 10, the tongues (10) are not screwed to the subfloor (11), but rather are secured in place with respect to one another by means of alignment laths (70) placed perpendicular to the tongues (10). As for the tongues (10), they rest on flexible supports (80), made of rubber, or other similar material, reaching out over their entire length. The fastening system is secured in place on the surface to be lined only by gravity, which makes it possible to install it directly on an existing lining without damaging it. It is also possible to install it on carpets if it is not feasible, or permitted, to remove the latter.

The installation of a floor held in place by gravity is especially useful for apartments or temporary exhibits, either for cases when the tenant does not have the right to damage the existing floor and when he wants to take it with him when he moves to reuse it elsewhere.

In the second preferred embodiment, the tongues (10) have lateral walls (90) projecting downward and reaching out over their entire length. The walls (90) serve to catch the flexible supports (80) as in a vise. The lower portion of the walls (90) rests on the sides (82) of the base of the flexible supports (80), as illustrated in FIG. 9. Bulges (92), placed inside the walls (90), make it possible to tighten the flexible supports (80) even more in order to hold them more effectively. To this end, the lateral walls of the flexible supports (80) have longitudinal grooves (84) used for receiving and blocking the bulges (92).

The lateral walls (90) have openings (94), evenly spaced, which allow the alignment laths (70) to be passed crosswise. The width of the openings (94) is smaller than the width of the alignment laths (70), but these are provided with recesses (72), evenly spaced, placed in twos on their sides, as illustrated in FIG. 6. The distance between the recesses (72) of the same lateral edge is equal to the width of the tongues (10). The alignment laths (70).may be easily shortened using marks (74) serving as a cutting mark, thereby making it possible to maintain the synchronization of the installation, the alignment laths (70) being jointed together at the level of the tongues (10).

To install this fastening system, we first place flexible supports (80), then perpendicularly, we place alignment laths (70) facing each other where the openings (94) will be. Then, when the entire assembly is properly aligned, the tongues (10) are placed above the flexible supports (80) and the alignment laths (70) are fitted together. The tongues (10) must be placed so that their teeth (14) are all in the same direction.

As illustrated in FIG. 10, the installation of the laths (20) takes place in the same manner as in the first embodiment.

The laths (20) of the last row must be fastened using an auxiliary means in order to prevent them from raising. If the last laths (20) project into the wall slightly, this may be accomplished, for example, using a finishing quadrant placed above these. Other methods are also possible.

The lath fastening system described above is very effective for correcting the laths (20) which are cambered, because they are kept straight in the bearings (12) which form an individual vise. This makes it possible to keep the laths (20) in closer contact between one another by limiting the stress due to humidity. Moreover, the laths (20) no longer come into direct contact with the subfloor, which is often much more humid than the laths (20), since they rest on tongues (10). It therefore prevents the laths, which would bulge because of excess humidity, from encroaching on the space occupied by the adjacent laths, thereby limiting the possibility of a space between the laths, because of a later humidity decrease.

Since no nail passes through the laths (20), the probabilities of cracking will not be very reduced when people will walk on the laths. Actually, the absence of large cracks caused by nails during the traditional installation prevents two parts of the same lath (20) from rubbing together and causing noise. The present invention, keeping the laths (20) intact, makes it possible to solve this problem.

Finally, it is possible to create a floor with various patterns by alternating perpendicular sections with one another. It is also possible to create tongues (10) whose bearings (12) form an angle or are parallel to their longitudinal axis in order to meet certain design criteria.

I claim:

1. A fastening system for assembling laths (20) on a lining surface (11) so that the laths (20) are juxtaposed and parallel, each of said laths (20) having a given width and being provided with an upper surface (22), a lower surface (24) and two lateral sides (26, 28), one of said sides of each of the laths comprising a tenon (36), the other of said sides comprising a mortise (38), whereby the tenon (36) of each lath can be inserted into the mortise (38) of an adjacent lath (20), said fastening system comprising:

(a) a set of rigid tongues (10), for being placed parallel to one another on the lining surface (11) in order to receive the lower surfaces (24) of the laths (20), said tongue (10) projecting in a direction crosswise to the laths (20) said tongues resting against flexible supports (80) placed between the lining surface (11) and the tongues (10);

(b) securing means for securing said tongues (10) in place with respect to one another;

(c) a set of bearings (12) arranged on and projecting upwardly on said tongues (10), the bearings (12) having between them a distance substantially equal to the width of the laths (20), each of said bearings (12) being provided with an upper end substantially curved according to a 90° angle in order to form at least one tooth (14) essentially parallel to the tongues (10);

(d) each said tooth (14) being curved in the same direction, each of said bearings (12) being dimensioned so that the tenon (36) of one of the laths (20) can bear against its tooth (14) and the mortise (38) of another lath (20) can be inserted around the tenon (36) and the corresponding tooth (14) so as to prevent the laths (20) from raising and allowing them to be placed parallel to one another, and when said tongues (10) are placed parallel to one another on the surface to be lined, the bearings (12) of each of the tongues (10) being aligned crosswise with the bearings (12) of the other tongues (10);

(e) the tongues (10) having lateral walls (90) projecting downwardly and reaching out in the longitudinal direction of the tongues (10) so that each tongue (10) forms an individual vise around its corresponding flexible support (80);

(f) said securing means for securing in place said tongues (10) with respect to one another including a set of alignment laths (70) placed perpendicular to the tongues (10), with respect to lateral openings (94) made in the lateral walls (90) of the tongues (10); and (g) said alignment laths (70) having lateral edges provided with pairs of symmetrical recesses (72) fitting together with the lateral walls (90) around lateral openings (94) and cross the tongues (10) by passing between them and their flexible support (80), said tongues (10) and said alignment laths (70) being arranged so that each of the tongues (10) fits together with the symmetrical recesses (72) when the alignment laths (70) cross it.

2. Fastening system according to claim 1, wherein said at least one tooth (14) has a pointed end projecting upward slightly.

3. Fastening system according to claim 2, and including at least two teeth (14).

4. Fastening system according to claim 1, wherein each of the laths (20) have the same width and the bearings (12) of the same tongue (10) are equidistant in order to synchronize the installation of the laths (20).

5. Fastening system according to claim 4, wherein the laths (20) include grooves (46).

6. Fastening system according to claim 1, wherein the laths (20) are made of wood and their upper surface (22) is prevarnished.

7. Fastening system according to claim 1, 2 or 3 wherein the securing means for securing said tongues (10) in place with respect to one another include holes (42) through the tongues (10), in which screws (44) are placed, which screws (44) are provided with a head (45) penetrating the lining surface (11).

8. Fastening system according to claim 7, wherein the holes (42) are evenly spaced from each other.

9. Fastening system according to claim 1, characterized in that the flexible supports (80) project in the longitudinal direction of the tongues (10).

10. Fastening system according to claim 9, wherein the flexible supports (80) are made of a polymer.

11. Fastening system according to claim 1, wherein the tongues (10) are evenly spaced between them and the recesses (72) of the alignment laths (70) are evenly spaced.

12. Fastening system according to claim 11, wherein the lateral walls (90) of the tongues (10) comprise pairs of bulges (92) making it possible to more effectively secure the tongues (10) as in a vise around flexible supports (80).

13. Fastening system according to claim 1, wherein the laths (20) are held in place on the lining surface (11) only by gravity.

14. Fastening system according to claim 1, wherein the tongues (10) are made of tempered steel.

15. Fastening system according to claim 1, wherein the alignment laths (70) are made of metal.

* * * * *